US006460274B1

(12) United States Patent
Mateu

(10) Patent No.: US 6,460,274 B1
(45) Date of Patent: Oct. 8, 2002

(54) FOOTWEAR PART OF A BOOT OR EQUIPMENT INVOLVING A FOOTWEAR COMPONENT

(75) Inventor: Christophe Mateu, Cres (FR)

(73) Assignee: Holy International, Craponne (FR)

( * ) Notice: Subject to any disclaimer, the term of this patent is extended or adjusted under 35 U.S.C. 154(b) by 0 days.

(21) Appl. No.: 09/445,183

(22) PCT Filed: Jul. 8, 1998

(86) PCT No.: PCT/FR98/01476

§ 371 (c)(1),
(2), (4) Date: Mar. 23, 2000

(87) PCT Pub. No.: WO99/02056

PCT Pub. Date: Jan. 21, 1999

(51) Int. Cl.[7] ..... A43B 5/16
(52) U.S. Cl. ..... 36/115; 36/50.5; 36/45
(58) Field of Search ..... 36/115, 116, 117.1, 36/117.2, 118.2, 118.9, 119.1, 117.4, 117.5, 117.6, 117.7, 117.8, 117.9, 50.5, 45

(56) References Cited

U.S. PATENT DOCUMENTS 3,362,091 A * 1/1968 Drago ..... 36/98
3,377,721 A * 4/1968 Johnson ..... 36/117.9
3,718,994 A * 3/1973 Spier ..... 36/117.1
4,969,278 A * 11/1990 Ottieri ..... 36/119
6,009,638 A * 1/2000 Maravetz et al. ..... 36/115

FOREIGN PATENT DOCUMENTS

| | | |
|---|---|---|
| DE | 196 19 677 A 1 | 7/1997 |
| EP | 0 754 413 | 1/1997 |
| EP | 0 765 614 | 4/1997 |
| WO | WO 97/09893 | 3/1997 |

* cited by examiner

*Primary Examiner*—Paul T. Sewell
*Assistant Examiner*—Jila Mohandesi
(74) *Attorney, Agent, or Firm*—Oliff & Berridge, PLC

(57) ABSTRACT

According to the invention, this footwear part (1) comprises a structural part (2) formed by a rigid sole (10), an enclosing edge (11) integral with the front part of this sole (10) and a sleeve part (12) integral with the rear part of this sole (10) and shaped so as to enclose the ankle and the lower leg of the user.

This sleeve part (12) is separate from the edge (11) and has walls offset toward the inside of the sole (10) relative to the wall of the edge (11), in such a manner that there are, on either side of this structural part (2), two slots (20), oriented substantially in a longitudinal direction, in which an upper (3) made from flexible or semi-flexible material may be engaged.

8 Claims, 2 Drawing Sheets

FIG 3
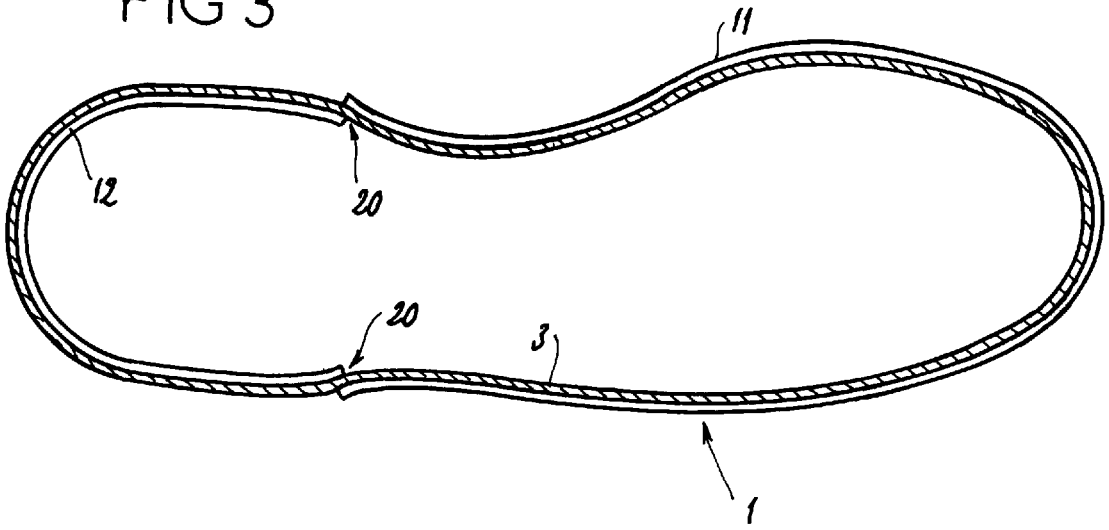
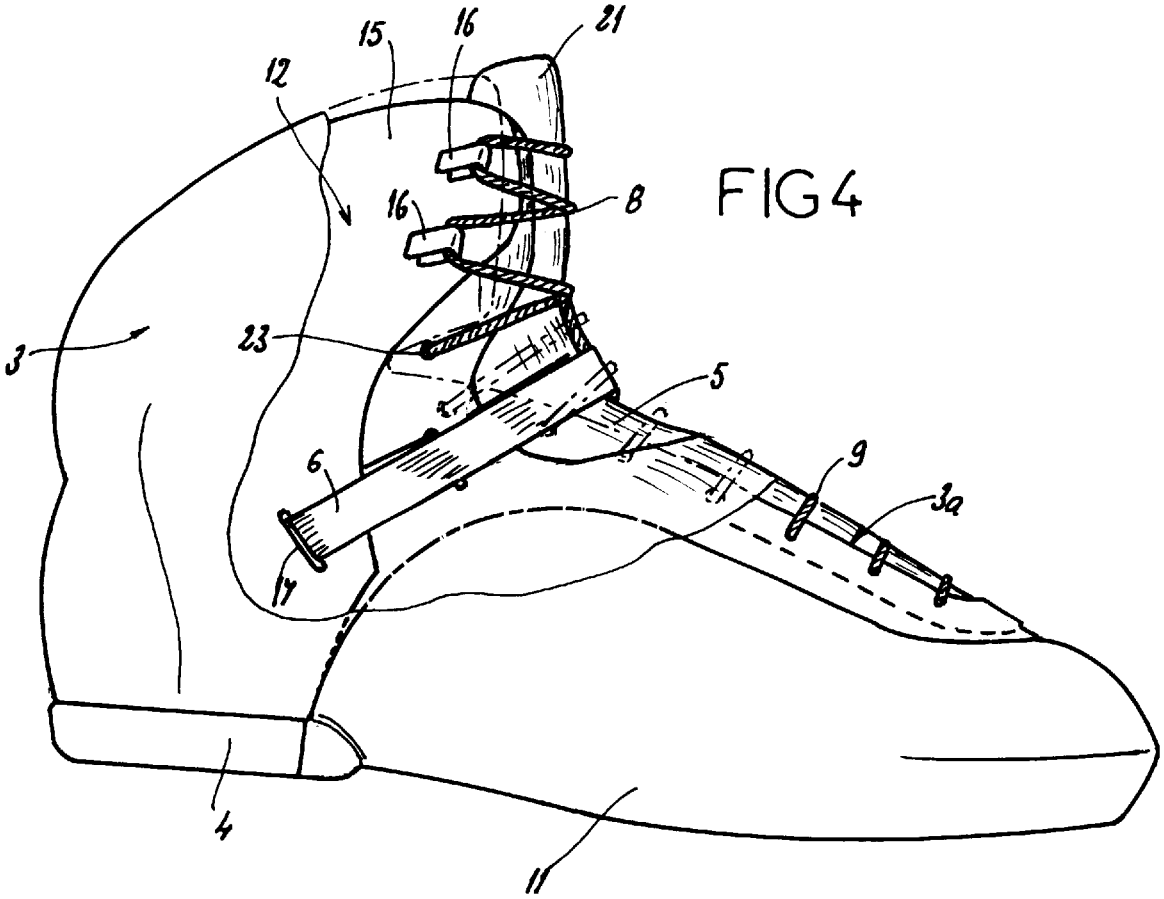
FIG 4

FOOTWEAR PART OF A BOOT OR EQUIPMENT INVOLVING A FOOTWEAR COMPONENT

The present invention relates to a footwear part of a boot or of equipment involving a footwear component, it being possible for this boot or this equipment to be used, in particular, during participation in a sport.

The invention may be applied in particular to inline roller skates, but could also be applied to cross-country skiing boots, for example.

Certain sports, such as skating or skiing, require the foot to be held securely in the footwear part and that a certain degree of freedom of movement of the leg relative to the foot is also retained.

To this end, it is known to produce a ski boot or a footwear part of a roller skate in the form of a rigid or semi-rigid plastic shell, shaped so as to enclose the user's foot and ankle, and of a sleeve part mounted pivotably on the rear part of the shell, about a transverse axis, in order to enclose the lower leg. The footwear part generally contains an inner boot made from flexible material and may be tightened around the foot using laces or buckle-type tightening members.

This type of boot or footwear part turns out to be relatively unsatisfactory for participating in sports involving movements of the leg relative to the foot in a number of directions: the limited possibilities of movement of the rear sleeve part relative to the shell lead to the leg repeatedly being constrained against the inner boot and the sleeve part. Such constraints give rise to pain and may cause wear and crushing of the inner boot and/or fatigue, deformation or tearing of this sleeve part, particularly at the fastening points of the means for tightening the sleeve part.

Moreover, this conventional structure does not allow the user, particularly if he is a top-level sportsman, to find the ideal compromise between the holding of the foot and the degree of freedom desired for the lower leg.

Furthermore, these existing footwear parts have the drawback of a visual appearance which is not always very attractive and which, in any case, it is scarcely possible to modify for individual clients.

The invention aims to remedy all these drawbacks.

To this end, the footwear part it relates to comprises:

a structural part formed by (i) a rigid sole, (ii) an enclosing edge integral with the front part of this sole and shaped so as to cover the front part of the user's foot and at least one of the lateral parts of this foot, substantially at the instep, and (iii) a sleeve part integral with the rear part of this sole and shaped so as to enclose the ankle and the lower leg of the user, this sleeve part being separate from said edge and having walls offset toward the inside of the sole relative to the wall of the edge, in such a manner that there are, on either side of this structural part, two slots oriented substantially in a longitudinal direction, each delimited by the wall of the edge and the wall of the sleeve part, and an upper made from flexible or semi-flexible material capable of being engaged in said slots, this upper being shaped so as to be engaged inside the space delimited by said edge and to be fixed to this edge, and so as to be engaged around said sleeve part, which it at least partially covers.

The edge thus forms a rigid or semi-rigid shield which protects the foot from the aggressive environment or possible impacts it may experience during use of the footwear part, particularly when taking part in sports. The sleeve part forms a semi-rigid stiffener, placed inside the upper, capable of precisely immobilizing the heel relative to the footwear part but having, in its upper part, sufficient flexibility to allow omnidirectional movements of the leg relative to the foot.

In addition to a complementary role of holding the foot and the leg, the actual upper makes it possible to obtain a general flexibility for the footwear part as a whole and gives it a particular visual appearance.

The structural part is preferably made from molded plastic, particularly from polyurethane, the sole, the edge and the sleeve part advantageously being molded as a single piece. The actual upper is advantageously made from leather or similar material and may be provided with stiffeners in suitable places.

This structural part and this upper may be in different colors, which, combined with the possibility of materials of different types, makes it possible to obtain footwear parts with an attractive and very varied visual appearance.

Preferably, said sleeve part comprises, in its lateral zones, means allowing the reception of a strap, passing over the user's instep, capable of being placed under tension.

When it is under tension, this strap makes it possible to hold the heel in the back of the footwear part and, consequently, to hold the foot perfectly in the latter. The sleeve part ensures secure reception of the strap, eliminating any risk of damage or of fatigue of its component material at this reception point. The strap is covered over by the upper and thus does not detract from the visual appearance of the footwear part.

According to a preferred embodiment of the invention, said reception means consist of apertures, made in the sleeve part, through which the strap is engaged and is able to slide while it is being placed under tension.

Furthermore, the sleeve part may comprise means for the reception on it of a member allowing its tightening around the leg, such as hooks in which the strands of a lace may be engaged.

These means and member thus make it possible to tighten this sleeve part independently of the tightening of the footwear part over the foot, the latter being achieved by other tightening members which the footwear part comprises in the upper or the aforesaid edge. The user may thus completely adapt the degree of tightening of the sleeve part and that of the upper to his specific sport.

Preferably, the aforesaid strap comprises two strands, the free ends of which include two passages in which a lace is engaged, and the sleeve part comprises hooks in which the strands of this lace may be engaged in order to tighten the sleeve part around the user's leg.

The strap is placed under tension and the sleeve part is tightened, therefore, by the same lace.

In order for the invention to be understood properly, it is described again hereinbelow with reference to the appended diagrammatic drawing which, by way of non-limiting example, shows a preferred illustrative embodiment of the footwear part to which it relates.

FIG. 3 is a view of this part and of this upper in section along the line III—III of FIG. 2; and FIG. 4 is a side view of the footwear part, with partial cutaway of the upper.

Figure 1:
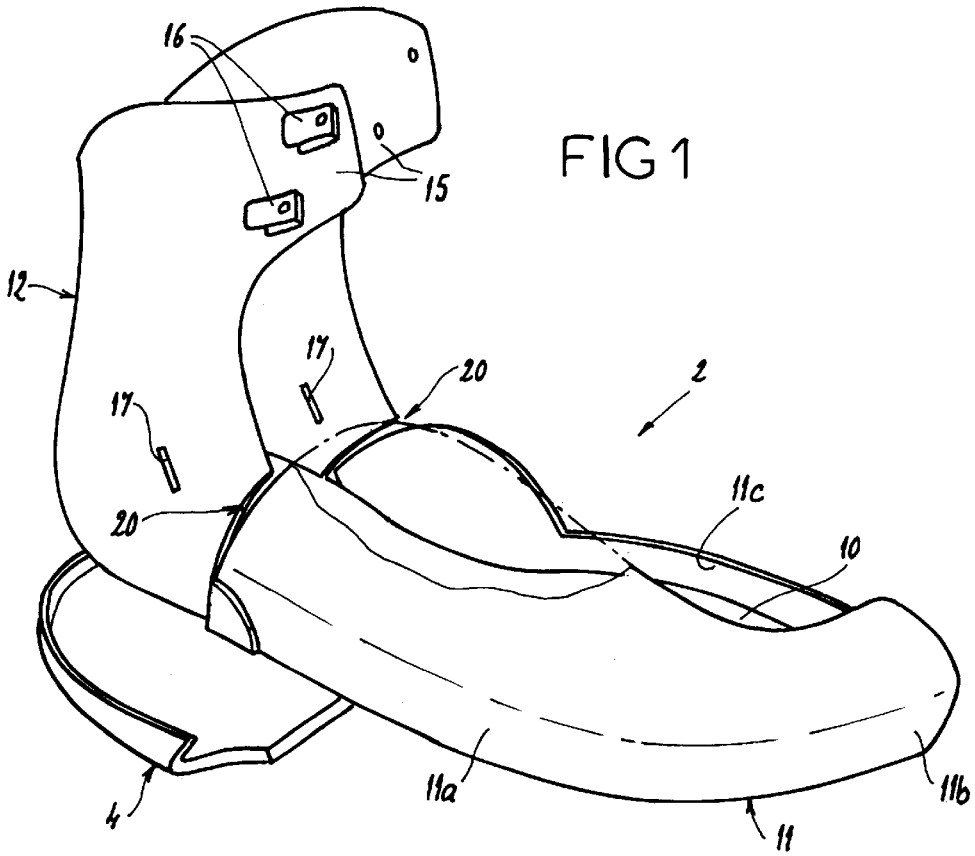
FIG. 1 is a perspective view of the structural part which it comprises.

This footwear part 1 comprises a structural part 2, an upper 3, a heel part 4, a padded inner boot 5, a strap 6 and two laces 8, 9.

FIG. 1 shows that the structural part 2 is formed by a sole 10, an edge 11, and a sleeve part 12, the whole assembly being molded as a single piece of plastic, particularly polyurethane.

The sole 10 is rigid owing to its thickness and/or the ribs it has on its upper face. When the footwear part 1 is that of an inline roller skate, the sole is connected to a longitudinal chassis (not shown) which includes the rollers.

The edge 11 has a thickness of the order of 3 to 5 mm, so that it is rigid or semi-rigid. It consists of a wall which follows the contour of the front part of the sole 10. This wall is an enclosing wall, i.e. it has an upper part which is slightly curved toward the inside of the sole 10, and is shaped so as to enclose the front part of the user's foot and the lateral parts of this foot, substantially at the instep.

The portions 11*a* and 11*b* of this edge 11, located, respectively, opposite the outside and the front of the foot, have a height which is greater than that of the portion 11*c* located opposite the inside of the foot. This portion 11*c* has a slightly concave shape which is widened opposite the arch of the foot.

The sleeve part 12 has a thickness of the order of 3 mm, so that it is semi-rigid. It is shaped so as to enclose the ankle and the lower leg of the user and is largely open over the front.

In its upper part, it ends in two tabs 15 intended to be crossed over when this sleeve part 12 is tightened over the user's lower leg. These tabs 15 include two pairs of hooks 16 in which the strands of the lace 8 may be engaged.

In its lateral regions, the sleeve part 12 comprises two apertures 17 through which the strap 6 is engaged and is able to slide.

Figure 2:
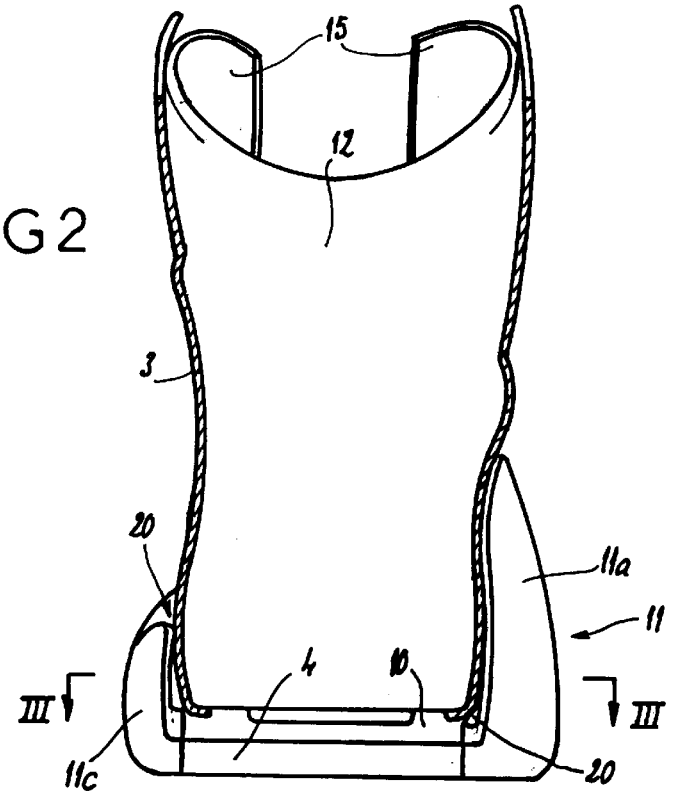
FIG. 2 is a view, from the rear, of this part and of the upper which the footwear part comprises, this upper being seen in vertical section.

FIGS. 1 to 3 show that the sleeve part 12 is separate from the edge 11 and that it has walls offset toward the inside of the sole 10 relative to the wall of this edge 11. There are thus, on either side of the structural part 2, two slots 20 oriented substantially in a longitudinal direction, each delimited by the wall of the edge 11 and the wall of the sleeve part 12.

The upper 3 is made from leather. As shown in the figures, it is capable of being engaged in said slots 20 and is shaped so as to be engaged inside the space delimited by the edge 11, and to be fastened to the latter, and engaged around the sleeve part 12, which it entirely covers over.

The heel piece 4 is intended to be fastened to the lower part of the sole 10, below the sleeve part 12, so as to trap the border of the upper 3 between it and this sole 10.

The inner boot 5 is made from flexible, padded material and comprises a tongue 21.

The strap 6 is sewn via its central part to this tongue 21. The two strands of the strap 6 defined by this sewing pass over the outside of the inner boot 5, through lateral apertures 22 which the latter comprises, then over the outside of the sleeve part 12, through the apertures 17, returning over the instep. Each of these strands comprises, at its free end, a loop formed by a hem, in which the lace 8 is engaged. The strands of this lace 8 may then be engaged in holes 23 in the inner boot 5, then in the hooks 16.

The actual upper 3 comprises two series of holes made along its two upper longitudinal borders 3*a,* the lace 9 passing through these holes.

The lace 8 thus allows tightening of the sleeve part 12 independently of the tightening of the footwear part 1 over the foot, produced by the lace 9, while the placing of the strap 6 under tension holds the user's heel in the back of the sleeve part 12.

What is claimed is:

1. Footwear part of a boot or of equipment involving a footwear component, particularly one which can be used for taking part in a sport, characterized in that it comprises:

a structural part (2) formed by (i) a rigid sole (10), (ii) an enclosing edge (11) integral with the front part of this sole (10) and shaped so as to cover the front part of the user's foot and at least one of the lateral parts of this foot, substantially at the instep, and (iii) a sleeve part (12) integral with the rear part of this sole (10) and shaped so as to enclose the ankle and the lower leg of the user, this sleeve part (12) being separate from said edge (11) and having walls offset toward the inside of the sole (10) relative to the wall of the edge (11), in such a manner that there are, on either side of this structural part (2), two slots (20) oriented substantially in a longitudinal direction, each delimited by the wall of the edge (11) and the wall of the sleeve part (12), and an upper (3) made from flexible or semi-flexible material capable of being engaged in said slots (20), this upper (3) being shaped so as to be engaged inside the space delimited by said edge (11) and to be fixed to this edge (11), and so as to be engaged around said sleeve part (12), which it at least partially covers.

2. Footwear part according to claim 1, characterized in that the structural part (2) is made from molded plastic.

3. Footwear part according to claim 2, characterized in that the sole (10), the edge (11) and the sleeve part (12) are molded as a single piece.

4. Footwear part according to claim 1, characterized in that the upper (3) is made from leather or similar material.

5. Footwear part according to claim 1, characterized in that the sleeve part (12) comprises, in its lateral zones, means (17) allowing the reception of a strap (6), passing over the user's instep, capable of being placed under tension.

6. Footwear part according to claim 5, characterized in that said reception means consist of apertures (17), made in the sleeve part (12), through which the strap (6) is engaged and is able to slide while it is being placed under tension.

7. Footwear part according to claim 1, characterized in that the sleeve part (12) comprises means (16) for the reception on it of a member (8) allowing its tightening around the leg, such as hooks in which the strands of a lace may be engaged.

8. Footwear part according to claim 7, characterized in that the strap (6) comprises two strands, the free ends of which include two passages in which a lace (8) is engaged, and in that the sleeve part (12) comprises hooks (16) in which the strands of this lace (8) may be engaged in order to tighten the sleeve part (12) around the user's leg.

* * * * *